United States Patent [19]

Hightower, Richard L.

[11] Patent Number: 4,665,823

[45] Date of Patent: May 19, 1987

[54] PAPER SUPPORT BAR FOR A SHEET-FED PRINTING PRESS

[75] Inventor: Richard L. Hightower, Canoga Park, Calif.

[73] Assignee: Arthur S. Diamond, Ventura, Calif. ; a part interest

[21] Appl. No.: 794,181

[22] Filed: Nov. 1, 1985

[51] Int. Cl.[4] ..... B41F 13/24

[52] U.S. Cl. ..... 101/232; 101/420

[58] Field of Search ..... 101/407 R, 408, 416 R, 101/417, 418, 419, 420, 421, 422, 232; 271/175, 198, 204, 277, 208; 198/644, 681, 804, 836

[56] References Cited

U.S. PATENT DOCUMENTS

| | | | |
|---|---|---|---|
| 3,642,274 | 2/1972 | Herrington et al. | 101/420 X |
| 3,780,925 | 12/1973 | Ternes | 101/418 |
| 3,791,644 | 2/1974 | DeMoore | 101/422 |
| 3,929,069 | 12/1975 | Jahn | 101/232 |
| 3,972,413 | 8/1976 | Simeth | 101/232 |
| 4,297,945 | 11/1981 | Sano et al. | 101/401.1 |
| 4,369,963 | 1/1983 | Jamieson, Jr. | 101/420 |
| 4,402,267 | 9/1983 | DeMoore | 101/419 |
| 4,524,964 | 6/1985 | Jamieson, Jr. | 271/204 |
| 4,530,495 | 7/1985 | Zimmermann | 101/408 |
| 4,550,904 | 11/1985 | Union | 101/420 |

FOREIGN PATENT DOCUMENTS

| | | | |
|---|---|---|---|
| 13185 | 1/1979 | Japan | 271/208 |

OTHER PUBLICATIONS

"Method for Improving Friction Stability of Rubber--Like Material"; Xe Disc. Journal, vol. 5., No. 4, Jul.-/Aug. 1980, p. 367.

Plastics World, Jan. 1982, vol. 40, No. 1, pp. 5, 36.

*Primary Examiner*—E. H. Eickholt

*Attorney, Agent, or Firm*—Marvin E. Jacobs

[57] ABSTRACT

A paper support bar for replacing the "star wheels" in a sheet-fed, offset printing press, or the like, having a chain delivery system. The bars are formed from hollow cylinders of a resiliently rigid, non-brittle material having adjustable supports on the ends for releasably connecting the bar to the chains of the press and for centering and horizontally supporting them. In the preferred embodiment, the plastic material is a plastic capable of resisting heat generated by infra red or thermal drying devices sometimes used on the delivery end of a press such as polypropylene or a high density polyethylene and contains an electrically conductive carbon black, antistatic agent, or other triboelectric charge directing agent.

9 Claims, 15 Drawing Figures

PAPER SUPPORT BAR FOR A SHEET-FED PRINTING PRESS

BACKGROUND OF THE INVENTION

The present invention relates to offset printing presses and the like and, more particularly, to an improved paper support bar for mounting on the chain delivery system of a printing press comprising an elongated hollow cylinder of high-density polyethylene, polypropylene, or other rigid, non-brittle material containing electrically conductive carbon black, antistatic agent, or other triboelectric charge directing agent; a pair of metal plugs secured into respective ends of the cylinder, each plug having a longitudinal bore therethrough; a pair of longitudinal bar members disposed as a sliding fit within respective ones of the bores, the bar members each having an outer end adapted to clip onto the links of one of the chains and an inner end; and, a pair of compression springs disposed within the cylinder around respective ones of the bar members between the inner end thereof and the adjacent plug.

The critical portions of an offset printing press as wherein the present invention is intended for use are shown in simplified form in a side view in FIG. 1. To effect the printing operation, there are three cylinders moving in contacting relationship to one another. The plate or master cylinder 10 contacts the blanket cylinder 12 which, in turn, contacts the impression or backup cylinder 14. The impression cylinder 14 includes gripping fingers (not shown). As a sheet of paper 16 is fed from the supply stack 18 as by the feed roller 20, the gripping fingers on the impression cylinder 14 grip the leading edge of the paper sheet 16, thus pulling the paper sheet 16 between the blanket cylinder 12 and impression cylinder 14 on the surface of the impression cylinder 14 as it rotates in the direction indicated by arrow 22.

As best seen in FIG. 2, a pair of parallel, spaced chains 24 are mounted on sprockets 26 which, in turn, are mounted on driven shaft 28. The driven shaft 28 is mounted parallel to and close adjacent the surface of the impression cylinder 14. As a result, the chains 24 move towards, past, and then away from the surface of the impression cylinder 14, as indicated by the arrows 30 in FIG. 1. The chains 24 are used to effect the removal of printed paper sheets 16 in a manner shown in simplified form in FIGS. 4–7.

Referring first to FIG. 4, the paper sheet 16 is gripped along its leading edge by the fingers (not shown) previously described as being incorporated into the impression cylinder 14. The fingers are opened and closed by the drive mechanism for the impression cylinder 14 in a manner which is unimportant to the present invention. The fingers are located in the area indicated by the arrow 32. A gripper bar 34 is mounted between the chains 24 so as to move in combination therewith. The gripper bar 34 is shown in greater detail in FIG. 8. The gripper bar 34 contains a plurality of hinged gripping fingers 36 which can be opened and closed in combination by the movement of arm 38 which, in turn, is moved by roller 40 moving along a camming surface (not shown).

Returning to FIG. 4, as the paper sheet 16 moves out from between the point of contact between the blanket cylinder 12 and the impression cylinder 14, the top surface 42 is imprinted with an ink image as a result of the printing process. As the paper sheet 16 moves towards the driven shaft 28, the gripper bar 34 is moving towards the impression cylinder 14. That is, the leading edge of the paper sheet 16 and the gripper bar 34 are moving towards a point of close proximity. When they come together as shown in FIG. 5, the fingers on the impression cylinder 14 release their grip on the sheet of paper 16 while, simultaneously, the gripping fingers 36 of the gripper bar 34 seize the leading edge of the paper sheet 16. As the impression cylinder 14 and sprockets 26 continue to rotate, the paper sheet 16 is pulled from the surface of the impression cylinder 14 and away from it by the gripper bar 34. Finally, as shown in FIG. 7, with its momentum in the direction of arrow 44, the paper sheet 16 is released by the gripper bar 34 causing it to strike stripper finger 47 and fall into the takeup tray 46.

Returning now to FIGS. 2 and 3, as the paper sheet 16 is removed from the surface of the impression cylinder 14 by the gripper bar 34, it is important that the paper sheet 16 be kept close adjacent the surface of the impression cylinder 14 during the change in direction so as to prevent creasing of the paper 16 and/or smearing of the freshly deposited ink on the top surface 42. To this end, one or more so-called "star wheels", generally indicated as 48, were mounted on the driven shaft 28 between the sprockets 26. The star wheels 48 were held onto the driven shaft 28 by set screws 50. The periphery of the star wheels 48 were provided with projections 52 so that the top surface 42 of the paper sheets 16 would be contacted only at discreet points in an attempt to reduce or eliminate "tracking", i.e., imperfections in the printed top surface 42 resulting from contacting the still-wet ink before it has an opportunity to dry and redepositing it in other areas of the printed copy sheet. The tracking problem is particularly acute where there are large areas of solid color. The prior art star wheels 48 have two major problems. First, they are prone to produce tracking. Second, and more important, they are prone to falling off of the driven shaft 28 as a result of the loosening of the set screw 50, often resulting in catastrophic damage to the impression cylinder 14. In an effort to remove the troublesome star wheels, it was found many years ago that one could stretch rubber bands between paperclips clipped onto the chains 24. The rubberbands, however, were prone to breakage causing the paperclips to fall into the mechanism. Their use, however, did demonstrate that horizontal support members carried by and between the chains 24 could effectively replace the star wheels. Using that basic idea, one manufacturer of offset printing equipment (Offset Engineering Co., Inc. of Encino, Calif. has provided support bars such as that generally indicated as 54 in FIG. 8. These "Sheetech" prior art bars 54 are sized for the distance between the two chains 24, are of metal, and have spring loaded clips 56 on the ends thereof for gripping the chains 24. There are three gripper bars 34 on the typical press and the prior art Sheetech bars 54 are usually positioned with from one to three bars 54 between each gripper bar 34. Additionally, each bar 54 has a plurality of plastic three or four pointed members 55, as shown in FIG. 13, movably press fit thereon along the length thereof. The points of the members 55 create small areas of contact in the same manner as the star wheels and or the same purpose. Each of the points of the members 55 is of a different length so as to be able to contact the paper in a different manner. Unfortunately, the prior art Sheetech bars 54 are not a significant improvement over the old star wheels. The members 55 still produce tracking and, therefore, they must be adjusted for each new printing job so as to contact the printed paper at points where there is no ink on the surface. Additionally, despite their gripping ends, the Sheetech bars 54 are not immune to becoming dislodged from the chains 24 and, should they do so, they can fall into the impression cylinder 14, again causing catastrophic damage thereto.

Wherefore, it is the object of the present invention to provide a support bar for use on offset printing presses and the like which will virtually eliminate tracking without the necessity for constant readjusting and which will be harmless to the impression cylinder and other working parts of the press should it become dislodged from its working position .

SUMMARY

The foregoing objective has been met by the star bar of the present invention wherein each bar comprises a hollow cylinder of a resiliently rigid, non-brittle plastic material having triboelectric charge directing properties and being resistive to printing ink and printing ink solvents; and, adjustable support means carried adjacent to and within the respective ends of the cylinder for releasably connecting the bar to the chain and for centering and horizontally supporting the bar.

In the preferred embodiment, the plastic material is polypropylene or high-density polyethylene containing electrically conductive carbon black, antistatic agent, and/or other triboelectric charge directing agents.

Further in the preferred embodiment, the adjustable support means comprises adjacent each end of the cylinder a metal plug secured into the end, the plug having a longitudinal bore therethrough; a longitudinal bar member disposed as a sliding fit within the bore, the bar member having an outer end adapted to clip onto the links of the chain and an inner end; and, biasing means disposed within the cylinder and connected to the inner end for urging the outer end towards the plug.

To provide working clearance in relationship to parts of the press in the preferred embodiment, the metal plug extends outwardly from the end of the cylinder and includes a portion having a reduced diameter.

DESCRIPTION OF THE PREFERRED EMBODIMENT

Figure 9:
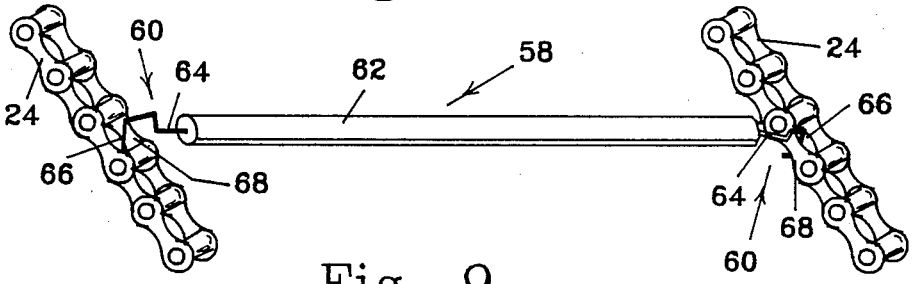
FIG. 9 is a perspective view of a star bar according to the present invention mounted between the chains of an offset press.

Turning first to FIG. 9, the star bar of the present invention is generally indicated as 58 and shown suspended between the two parallel chains 24 by adjustable supports at each end which are generally indicated as 60. The star bar 58 is in the form of an elongated, hollow, plastic cylinder 62 having the adjustable supports 60 adjacent to and within the respective ends thereof.

Figure 8:
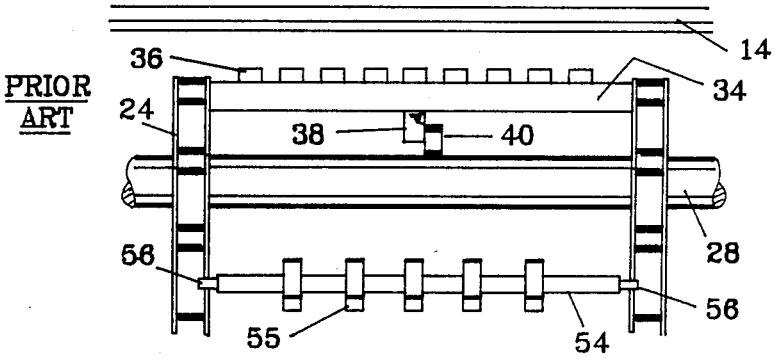
FIG. 8 is a view corresponding to the view of FIG. 2 showing a prior art Sheetech bar used to replace the star wheel of FIG. 3.
Figure 10:
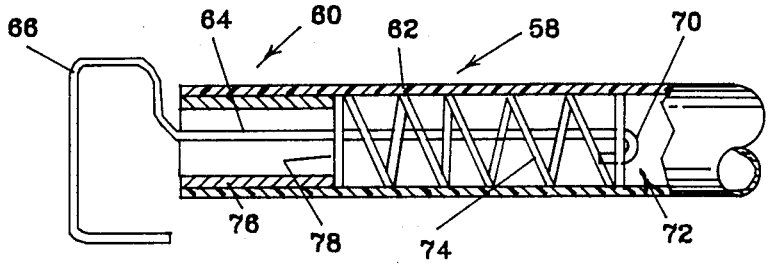
FIG. 10 is a cutaway drawing through one end of a star bar according to the present invention showing an early version of the adjustable support means thereof in its retracted position.
Figure 11:
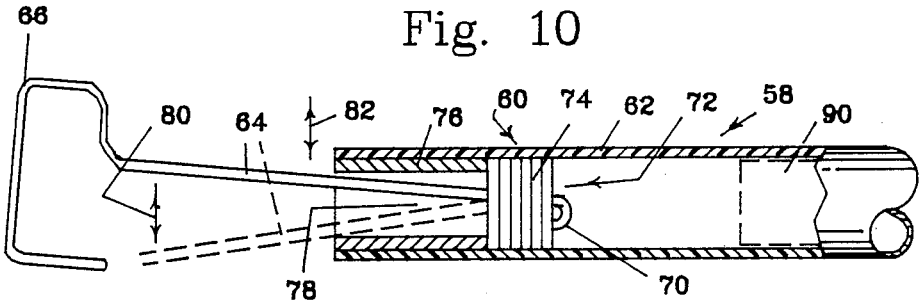
FIG. 11 shows the adjustable support means of FIG. 10 in its extended position.

The construction of the adjustable supports 60 according to an early experimental embodiment of the present invention is shown in FIGS. 10 and 11. The experimental embodiments described hereinafter are included by way of example to teach those skilled in the art the pitfalls of certain design and material choices encountered by the applicant herein in attempting to find a suitable and workable replacement for the metal bar previously described herein with respect to FIG. 8.

In the first tested embodiments of the present invention, corresponding to FIGS. 10 and 11, the hollow plastic cylinder 62 was formed of crystal polystyrene to which a special, high electrical conductivity carbon black had been added in an attempt to give the bar 58 triboelectric charge directing characteristics. That is, it was intended to create a bar with electrostatic properties which would enable it to repel the paper and printing ink and, thereby, avoid the tracking problem.

To create the adjustable supports 60, an elongated bar member 64 was inserted into each end of the cylinder 62. The outer end 66 was bent into a hook shape adapted to slip over the side member 68 of a link in the chains 24 as best seen in FIG. 9. The inner end 70 of the bar member 64 was hook-shaped and adapted to grip the inner end 72 of a compression spring 74 disposed within the cylinder 62 and around the member 64. A brass sleeve 76 was press-fit into the end of the cylinder 62 to bear against the outer end 78 of the spring 74. The spring 74 was placed under slight compression such that it created a biasing force against the inner end 70 of the spring 74 tending to urge the outer end 66 towards the sleeve 76, i.e. to the retracted position of FIG. 10. The outer end 66, of course, was easily gripped and pulled outward to the extended position of FIG. 11 compressing the spring 74.

Constructed as shown and just described of the indicated materials, the star bar 58 was not suitable for its intended purpose. In the static state, the star bar 58 employing the adjustable support system of FIGS. 10 and 11 mounted easily to the chains 24. During operation, however, the various forces on the bar 58 caused it to oscillate and move from its proper operational position and quickly become dislodged from the chains 24. Once it fell into the moving mechanism, it most usually shattered and was rendered useless. Of a positive note, the styrene plastic did not cause damage to the impression cylinder 14.

Further investigation and testing led to selection of the materials and modification to the design of the preferred embodiment which will now be described with particularity. In addition to possessing the desired triboelectric charge directing properties and being of a plastic or plastic-like material so as to prevent damage to the impression cylinder 14, it was realized that the material of the cylinder 62 had to be resiliently rigid while, at the same time, being non-brittle. Additionally, it had to be resistive to printing ink and printing ink solvents, which the polystyrene was not. Also, because of the infrared or thermal drying devices often used on the delivery end of a press, it was realized that the material would have to be capable of withstanding temperatures of 140 to 150 degrees F. Due to the manner of operation of an offset press, it was concluded that it might also produce or augment the desired tracking resistance if the material of the cylinder 62 could also exhibit hydrophilic characteristics. In an offset press, during startup, water is first circulated, followed by the oil-based inks. It was concluded that if the cylinder 62 had hydrophylic characteristics, it would coat with the aqueous fountain solution water, aiding it to thereafter reject the oil-based inks such that, in combination with the effect of the static charge directing effect of the triboelectric properties, the oil-based inks would be effectively repelled from contacting the bar 58 in any manner which would cause tracking. The unique combination of material finally found by the applicant to possess all the desired and required properties to achieve satisfactory operation is a high-density polyethylene molding resin containing up to twenty-five percent by weight of electrically conductive carbon black. In the successfully tested embodiment of the present invention, the polyethylene is that sold by the Gulf Corporation under the designation Gulf 9410 HDPE. The carbon black is a special carbon black sold by the Cabot Corporation under the designation Vulcan XC-72R. A suitable substitute for the polyethylene would be Phillips Petroleum's 5502 HDPE. Likewise, a suitable substitute for the carbon black would be Columbian Chemical's Conductex 975 black.

It is also believed that, while not preferred, a number of other materials possess the required characteristics and could, therefore, also be used. The major required characteristics of the resin are that it be tough (i.e., non-brittle), resilient, and resistant to system inks and solvents. The organic resins (both synthetic and natural) that meet these requirements include; (a) linear polyamids such as that sold under the trade name Nylon; (b) linear polyesters such as polyethylene terephthalate sold under the trade name Mylar; (c) hydrocarbon or halogenated hydrocarbon resins such as polyalkylene, polyethylene, polypropylene or ethylene-propylene copolymers; (d) fluoronated hydrocarbons such as polytetrafluoroethylene sold under the trade name Teflon; and, (e) acrylonitrile butadiene styrene (ABS). Of particular possibilities are those plastics which are of the self-lubricating type (such as polytetrafluoroethylene) since their low-friction surface tends to be resistant to adherence or attachment to most materials including the inks used in the printing process. More particularly, since the inks used in the presses of particular interest to the present invention are oil based, these self-lubricating plastics exhibit oleophobic characteristics which cause them to repel the oil-based inks.

If desired, other trace antistatic agents, dyes and pigments well known to those skilled in the art can also be added to or substituted for the carbon black.

It is believed by the applicant herein that a triboelectric charge is generated in the star bar of the present invention as it travels through and exchanges electrons with the air. The resultant build-up of a surface electrostatic charge is such that it can attract or repel paper and can also attract or repel an inked image carried on the paper.

Turning once again to FIG. 11, the bar members 64 were constructed of a tempered wire often referred to as "piano wire". With the brass sleeve 76 employed at the outer end of cylinder 62, it can be seen that the bar member 64 had an arc of movement within the sleeve 76 as indicated by the arrow 80. Thus, as the bar 58 was moved along with the chains 24, it was free to move backwards and forwards independently at the respective ends thereof. More important, during the critical point of proximity to the impression cylinder 14, the centrifugal forces imparted by the bend around the sprocket 26 were such as to cause an upward and outward motion along the direction indicated by the arrow 82. Thus, the bar 58 not only did not maintain its correct horizontal alignment with respect to the chains 24 (and thereby its proper spaced relationship to the impression cylinder 14 during passage thereby); but, it was also free to oscillate up and down in the direction of the arrow 82. Thus, despite the inward urging force of the compression spring 74 tending to hold the shaped outer end 66 around the link side member 68, the bar 58 would come off the chains 24.

Figure 12:
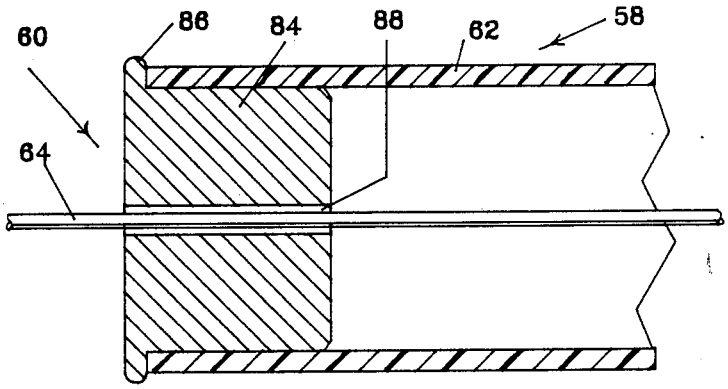
FIG. 12 is a cutaway view through the end of a star bar according to the present invention in its preferred embodiment showing the supportive plug used therein to maintain horizontal alignment of the bar.
Figure 13:
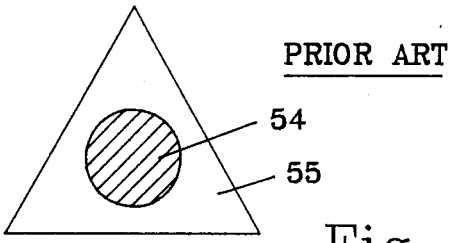
FIG. 13 is a side view through the bar of FIG. 8 showing the shape of the plastic members pressed thereon.

Both the non-alignment and dislodging problems were eliminated by the specially designed plug member 84 of FIG. 12, which is used to replace the brass sleeve 76 of FIGS. 10 and 11 in the preferred and successful embodiment. Other than that necessary change for operability, the design and construction of the adjustable supports 60 as previously described with respect to FIGS. 10 and 11 remains the same. The plug member 84 is a cylinder of aluminum having a retaining ridge 86 circumferentially disposed about the outer end to provide for proper insertion and alignment. The plug member 84 is securely held into the ends of the plastic cylinder 62 by hot-pressing it in place. The plug member 84 has a longitudinal bore 88 therethrough which is concentrically disposed with respect to both the cylindrical plug member 84 and the cylinder 62. Moreover, the bore 88 is sized as a sliding fit with respect to the tempered wire of the bar member 64. Thus, there is virtually no arc of movement such as that previously described with respect to the earlier configuration of FIG. 11. Because of the stiffness of the piano wire of the bar member 64 and the support provided by the sliding fit bore 88 in plug 84, once the outer ends 66 of the adjustable supports 60 are clipped over the link side members 68, the cylinder 62 is centered and horizontally supported in its desired position. Moreover, because of the rigidity of the support, despite its adjustable nature, both the forward and backward motion and oscillatory vertical motion, previously described, are virtually eliminated. While a separate compression spring is shown as spring 74 in the figures, those skilled in the art will readily recognize that the same inward biasing force on the bar members 64 could be attained by employing separate tension springs attached within the cylinder and connected to the inner ends 70 or, in the alternative, by a single tension spring interconnecting the two inner ends 70.

Figure 1:
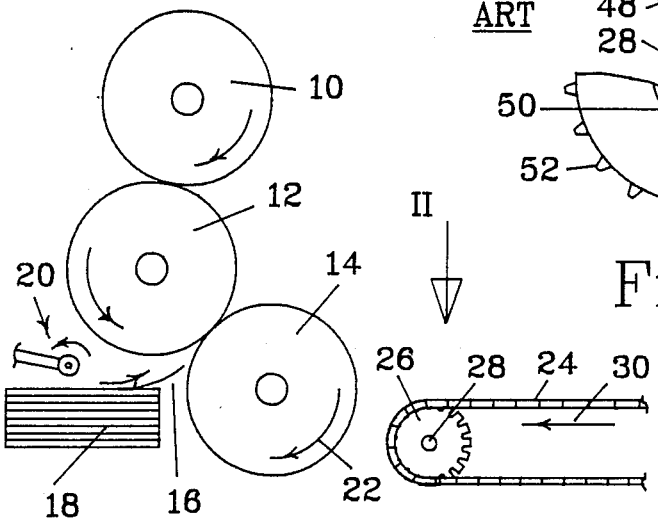
Fig. 1 PRIOR ART
FIG. 1 is a simplified side elevation of the components of an offset printing press wherein the present invention is used.
Figure 3:
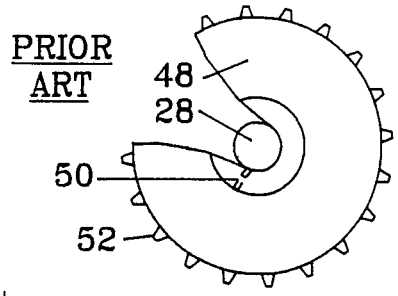
Fig. 3 PRIOR ART
FIG. 3 is a side view of a star wheel as seen in the direction indicated as III in FIG. 2.
Figure 2:
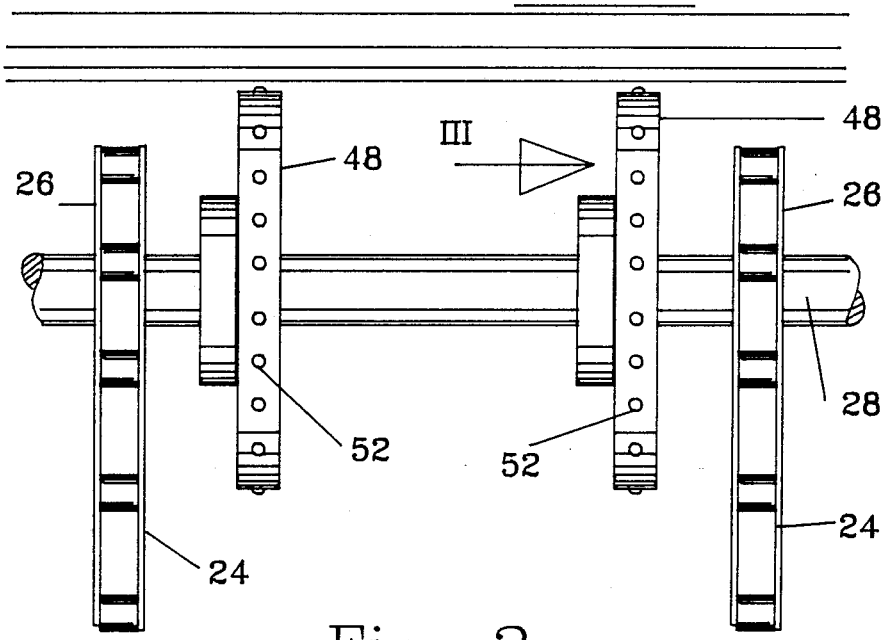
FIG. 2 is a top view of FIG. 1 in the area designated as II showing a prior art star wheel used for the same purpose as the present invention.
Figure 4:
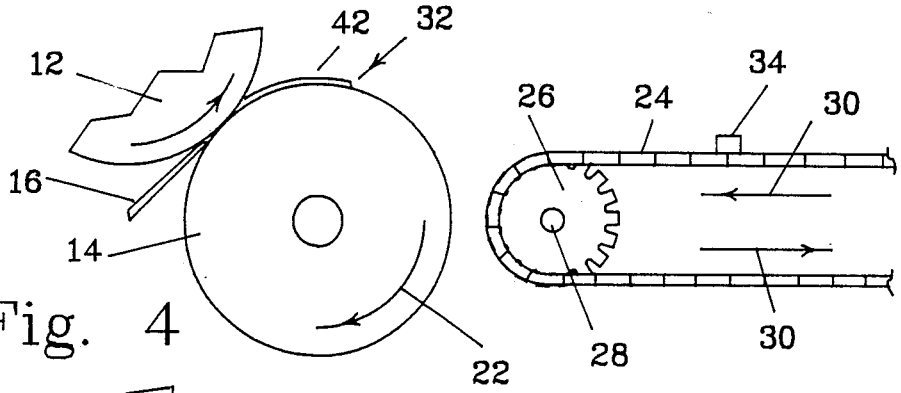
FIGS. 4–7 are enlarged side views of the apparatus of FIG. 1 showing the manner in which paper is transferred from the impression cylinder to the gripper bar carried by the chains.
Figure 5:
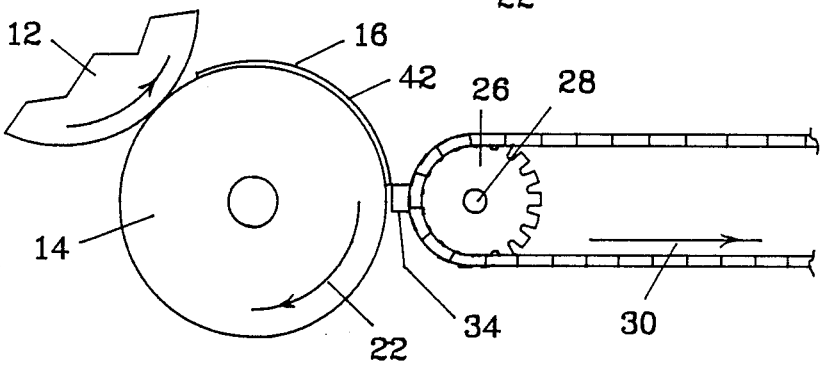
Figure 6:
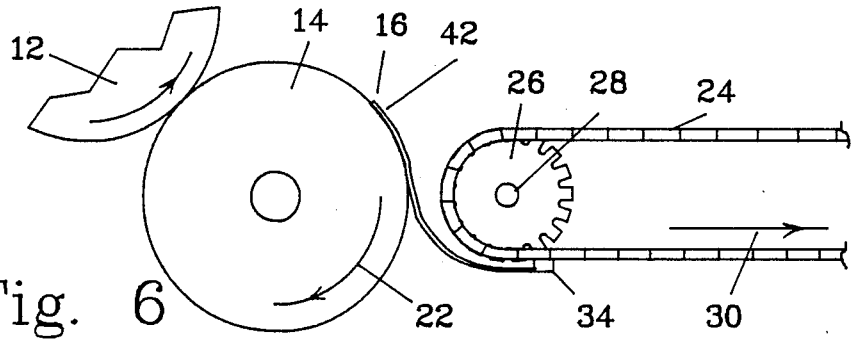
Figure 7:
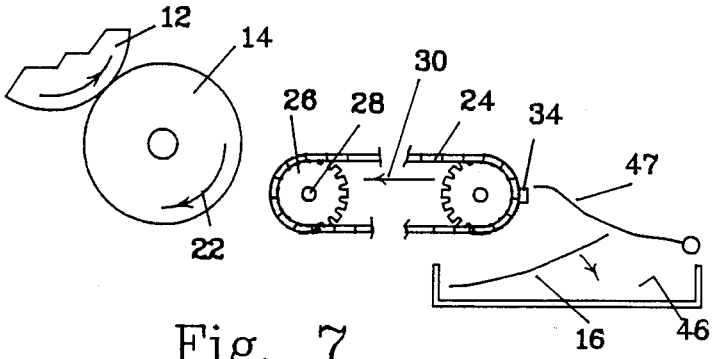
Figure 14:
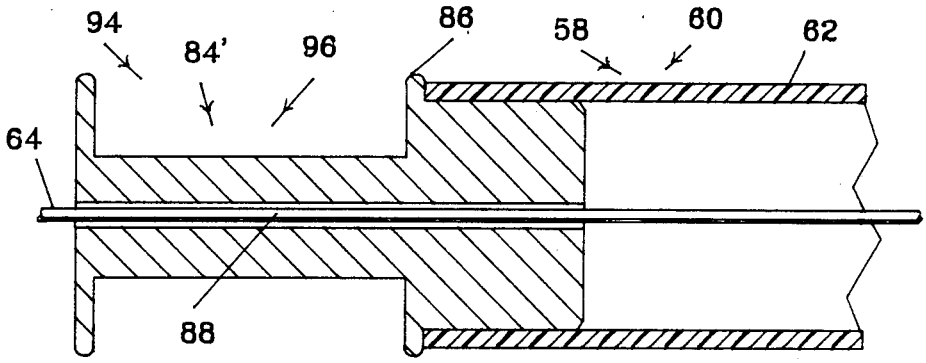
FIG. 14 is a cutaway drawing of a preferred embodiment of the supportive plug wherein the plug extends outwardly from the end of the cylinder and includes a reduced diameter portion to provide working clearance with relationship to press parts.
Figure 15:
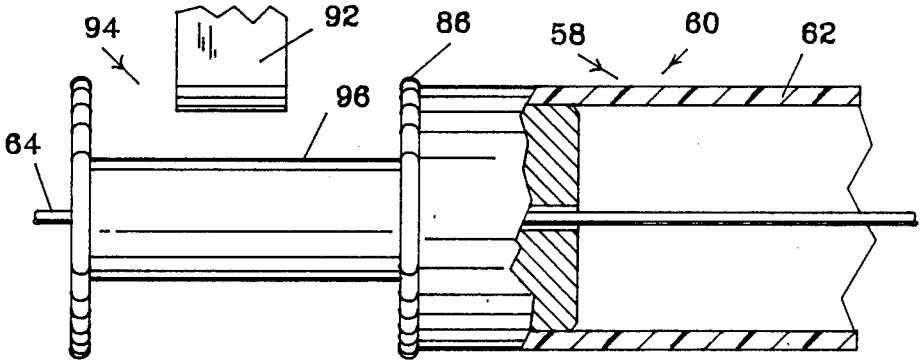
FIG. 15 is a drawing of the plug of FIG. 14 showing how it provides working clearance.

Turning now to FIGS. 14 and 15, a further problem solved by the present invention will now be described. With the elongated bar member 64 configured as described above and with the outer ends 66 attached to the link side members 68 of the chains 24, the top of the star bar 58 of the present invention is positioned slightly above the top of the chains 24. This allows the star bar 58 to be symmetrical about the bar member 64 and positions it well with respect to the surface of the cylinder 14 for purposes of maintaining the paper 16 in an optimal state as it is removed from the cylinder 14. As indicated as 92 in FIG. 15, however, there is typically at least one member adjacent one of the chains 24 as part of the working parts of the press which is used as part of the process of removing the paper 16 from the cylinder 14. The stripper finger 47 of FIG. 7 is a typical example. In its optimal position as described above, the cylinder 62 of the star bar 58 of the present invention tends to strike that member 92. To eliminate that problem, the preferred plug 84' of FIGS. 14 and 15 is employed. As can be seen, plug 84' includes a portion 94 which extends outwardly from the retaining ridge 86. Outwardly extending portion 94 includes a portion 96 of reduced diameter, i.e., less than the diameter of the cylinder 62, which provides the necessary clearance for the member 92. The same technique could, of course, be used to provide clearance for other working parts of a press. For example, if such a member were located at the center of the star bar 58, a central plug incorporating such a reduced diameter portion therein could be inserted into the center of the cylinder 62, thereby providing the necessary clearance for the working parts of the press.

With the present invention, the ink rejection properties are such that it is possible and preferred that a plurality of the star bars 58 be positioned between the gripper bars 34. In tested embodiments it has been found to be preferred to place three star bars 58 according to the present invention between each of the gripper bars 34.

Additionally, in longer star bars where there is a potential for sag and whip (particularly where the chains 24 make the bend and change of direction at the sprockets 26), a support member, such as indicated by the dotted lines 90 in FIG. 11, can be disposed within the cylinder 62 between the adjustable supports 60. The support member 90 can be a rod or cylinder of appropriate diameter and of any suitable lightweight material such as fibreglass, aluminum, or the like.

Wherefore, having thus described my invention, I claim:

1. In a sheet-fed offset printing press or the like having a pair of parallel chains for carrying a pickup bar mounted between the chains past a rotating drum to remove paper sheets therefrom, the improvement comprising:

(a) a plurality of support bars mounted between the chains parallel to and behind the pickup bar at spaced intervals for supporting the paper sheets close adjacent the drum during removal therefrom to prevent creasing of the paper; wherein each of said bars comprises, (b) a hollow cylinder of a resiliently rigid, non-brittle plastic material which is resistive to printing ink and printing ink solvents; and, (c) adjustable support means carried adjacent to and within the respective ends of said cylinder for releaseably connecting said bar to the chain and for centering and horizontally supporting said bar, said adjustable support means comprising adjacent each end of said cylinder, a plug secured into said end, said plug having a longitudinal bore therethrough;

a longitudinal bar member disposed as a sliding fit within said bore, said bar member having an outer end adapted to clip onto the links of the chains and an inner end; and, biasing means disposed within said cylinder and connected to said bar member for urging said outer end towards said plug.

2. The improvement of claim 1 wherein:

a portion of said plug is of a reduced diameter for providing clearance for working parts of the press while maintaining said bar at an optimum distance from the surface of the drum.

3. In a sheet-fed offset printing press or the like having a pair of parallel chains for carrying a pickup bar mounted between the chains past a rotating drum to remove paper sheets therefrom, the improvement comprising:

(a) a plurality of support bars mounted between the chains parallel to and behind the pickup bar at spaced intervals for supporting the paper sheets close adjacent the drum during removal therefrom, said bars being formed from a resiliently rigid, non-brittle plastic material which is resistive to printing ink solvents; wherein, (b) each of said bars is a hollow cylinder; and additionally comprising, (c) adjustable support means carried by each bar adjacent to and within the respective ends thereof for releasably connecting said bar to the chain and for centering and horizontally supporting said bar; said adjustable support means comprising adjacent each end of said cylinder, (d) a plug secured into said end, said plug having a longitudinal bore therethrough;

(e) a longitudinal bar member disposed as a sliding fit within said bore, said bar member having an outer end adapted to clip onto the links of the chains and an inner end; and, (f) biasing means disposed within said cylinder and connected to said bar member for urging said outer end towards said plug.

4. The improvement of claim 3 wherein:

a portion of each said bars is of reduced diameter for providing clearance for working parts of the press while maintaining said bar at an optimum distance from the surface of the drum.

5. In a star bar for mounting between the drive chains of a sheet-fed offset press or the like to functionally replace the star wheels thereof, the improvement comprising:

(a) forming the star bar of a resiliently rigid, non-brittle plastic material which is resistive to printing ink and printing ink solvents, able to withstand temperatures of up to 140 degrees F., and is an oleophobic characteristic exhibiting material which will tend to reject oil-based inks; and wherein, (b) the star bar is a hollow cylinder and includes adjustable support means disposed adjacent to and within the respective ends of said cylinder for releasably connecting the star bar to the chain and for centering and horizontally supporting the star bar; and wherein said adjustable support means comprises adjacent each end of said cylinder;

(c) a plug secured into said end, said plug having a longitudinal bore therethrough;

(d) a longitudinal bar member disposed as a sliding fit within said bore, said bar member having an outer end adapted to clip onto the links of the chains and and inner end; and, (e) biasing means disposed within said cylinder and connected to said bar member for urging said outer end towards said plug.

6. The improvement to a star bar of claim 5 and additionally comprising:

a portion of reduced diameter being included within the star bar for providing clearance for working parts of the press while allowing the star bar to assume an optimum working position.

7. The improvement to a star bar of claim 6 wherein: said plug includes said portion of reduced diameter.

8. In a star bar for mounting between the drive chains of a sheet-fed offset press or the like to functionally replace the star wheels thereof, the improvement comprising:

(a) providing the ends of the star bar with adjustable support means for releasably connecting the star bar to the chain and for centering and horizontally supporting the star bar; wherein, (b) the star bar is a hollow cylinder and said adjustable support means are disposed adjacent to and within the respective ends of said cylinder; and additionally, said adjustable support means comprises adjacent each end of said cylinder, (c) a plug secured into said end, said plug having a longitudinal bore therethrough;

(d) a longitudinal bar member disposed as a sliding fit within said bore, said bar member having an outer end adapted to clip onto the links of the chains and an inner end; and, (e) biasing means disposed within said cylinder and connected to said bar member for urging said outer end towards said plug.

9. An improved star bar for use on sheet-fed offset printing press or the like for mounting between a pair of parallel spaced feed chains comprising:

(a) an elongated hollow cylinder of high-density polyethylene containing up to twenty-five percent by weight electrically conductive carbon black;

(b) a pair of metal plugs secured into respective ends of said cylinder, each said plug having a longitudinal bore therethrough;

(c) a pair of tempered metal longitudinal bar members disposed as a sliding fit within respective ones of said bores, said bar members each having an outer end adapted to clip onto the links of one of the chains and an inner end; and, (d) spring bias means disposed within said cylinder and connected to respective ones of said bar members for urging said bar members to a retracted position with said outer ends close adjacent respective ones of said plugs.

* * * * *